US012768130B2

(12) United States Patent
Han

(10) Patent No.: US 12,768,130 B2
(45) Date of Patent: Oct. 20, 2026

(54) BLADE SUPPORT FRAME FOR DOZER AND METHOD OF MANUFACTURING THE SAME

(71) Applicant: HD CONSTRUCTION EQUIPMENT CO., LTD., Seongnam-si (KR)

(72) Inventor: Yonghee Han, Bucheon-si (KR)

(73) Assignee: HD CONSTRUCTION EQUIPMENT CO., LTD., Seongnam-si (KR)

( * ) Notice: Subject to any disclaimer, the term of this patent is extended or adjusted under 35 U.S.C. 154(b) by 1288 days.

(21) Appl. No.: 17/564,357

(22) Filed: Dec. 29, 2021

(65) Prior Publication Data

US 2022/0205215 A1 Jun. 30, 2022

(30) Foreign Application Priority Data

Dec. 29, 2020 (KR) ..... 10-2020-0186835

(51) Int. Cl.
*E02F 3/76* (2006.01)

(52) U.S. Cl.
CPC ..... *E02F 3/7613* (2013.01); *E02F 3/7618* (2013.01)

(58) Field of Classification Search
CPC ..... E02F 3/7613; E02F 3/7618; E02F 3/7609; E02F 3/7627; E02F 3/7631; E02F 3/80; E02F 172/272; E02F 172/81; E02F 172/811; E02F 172/816; E02F 172/82; E02F 172/821
See application file for complete search history.

(56) References Cited

U.S. PATENT DOCUMENTS 2,075,482 A * 3/1937 Thorpe ..... E02F 3/7613 172/827
2,749,630 A * 6/1956 Nave ..... E02F 3/7613 60/472
3,694,990 A * 10/1972 Pamer ..... E04C 3/06 29/463
4,053,017 A * 10/1977 Gill ..... E02F 3/845 172/430
2016/0186408 A1 6/2016 Hoyt et al.

FOREIGN PATENT DOCUMENTS

CN 109537656 A 3/2019
JP 5551726 B2 7/2014

OTHER PUBLICATIONS

Korean Office Action issued on Jul. 2, 2025, for corresponding Korean Patent Application No. 10-2020-0186835, with its English translation, 9 pages.

* cited by examiner

*Primary Examiner* — Justin C Mikowski
*Assistant Examiner* — Ashley A Kaercher
(74) *Attorney, Agent, or Firm* — Hauptman Ham, LLP

(57) ABSTRACT

An embodiment of the present disclosure relates to a blade support frame for a dozer, which supports a blade, the blade support frame including: a ball joint configured to support the blade so that the blade is rotatable; a front plate coupled to the ball joint; an upper plate disposed on an upper portion of the front plate and coupled to the front plate; a lower plate disposed on a lower portion of the front plate and coupled to the front plate; and an inner diaphragm disposed between the upper plate and the lower plate and configured to support a portion between the upper plate and the lower plate.

10 Claims, 10 Drawing Sheets

BLADE SUPPORT FRAME FOR DOZER AND METHOD OF MANUFACTURING THE SAME

CROSS-REFERENCE TO RELATED APPLICATIONS

This application claims benefit and priority to Korean Patent Application No. 10-2020-0186835, filed on Dec. 29, 2020, with the Korean Intellectual Property Office, the disclosure of which is incorporated herein in its entirety by reference.

TECHNICAL FIELD

An embodiment of the present disclosure relates to a blade support frame for a dozer and a method of manufacturing the same, and more particularly, to a blade support frame for a dozer, which is capable of inhibiting stress from being concentrated on a welded portion between a ball joint and a support frame body, and a method of manufacturing the same.

BACKGROUND

In general, a blade support frame for a dozer, which supports a blade, is manufactured by welding various parts. In this case, as the number of welded portions increases, thermal stress, which is applied to a board, is concentrated on the welded portions during welding, which causes a problem of damage to a periphery of the welded portion of the board of the blade support frame.

Specifically, a large amount of stress is concentrated on a welded portion between a ball joint for supporting the blade and a part welded to the ball joint, and the blade support frame is distorted or deformed, which causes damage to the welded portion or the periphery of the welded portion.

However, if the number of parts decreases, the number of welded portions decreases, but it is difficult to shape or manufacture the blade support frame.

As the number of welded portions increases, welding processes are added, which requires a large amount of time to manufacture the blade support frame.

SUMMARY

An embodiment of the present disclosure provides a blade support frame for a dozer, which is capable of reducing deformation of the blade support frame for a dozer and preventing damage to the blade support frame for a dozer by effectively dispersing a load applied to a welded portion of a ball joint for supporting a blade, and a method of manufacturing the same.

An embodiment of the present disclosure provides a blade support frame for a dozer, which supports a blade, the blade support frame including: a ball joint configured to support the blade so that the blade is rotatable; a front plate coupled to the ball joint; an upper plate disposed on an upper portion of the front plate and coupled to the front plate; a lower plate disposed on a lower portion of the front plate and coupled to the front plate; and an inner diaphragm disposed between the upper plate and the lower plate and configured to support a portion between the upper plate and the lower plate.

The inner diaphragm may include a plurality of diaphragm members disposed to be spaced apart from one another, and a spacing width between the plurality of diaphragm members may be smaller than a width of a coupling portion of the ball joint coupled to the front plate.

The blade support frame for a dozer may further include a rear plate disposed to be spaced apart from the front plate and having one side further protruding from the upper plate in one direction and the other side further protruding from the lower plate in the other direction.

The blade support frame for a dozer may further include a lateral plate disposed between the upper plate and the lower plate, spaced apart from the rear plate, and coupled to a lateral surface of the front plate.

The blade support frame for a dozer may further include a lug disposed on the rear plate or the upper plate and protruding upward to support a cylinder.

An embodiment of the present disclosure provides a blade support frame for a dozer, which supports a blade, the blade support frame including: a ball joint configured to support the blade so that the blade is rotatable; a front plate coupled to the ball joint; an upper plate disposed on an upper portion of the front plate and coupled to the front plate; a lower plate disposed on a lower portion of the front plate and coupled to the front plate; an inner diaphragm disposed between the upper plate and the lower plate, configured to support a portion between the upper plate and the lower plate, and including a plurality of diaphragm members disposed such that a spacing width therebetween is smaller than a width of a coupling portion of the ball joint coupled to the front plate; and a rear plate disposed to be spaced apart from the front plate and having one side further protruding from the upper plate in one direction and the other side further protruding from the lower plate in the other direction.

Still another embodiment of the present disclosure provides a method of manufacturing a blade support frame for a dozer that supports a blade, the method including: welding a front plate and a ball joint configured to support the blade so that the blade is rotatable; temporarily joining an inner diaphragm to a lower plate disposed on a lower portion of the front plate; temporarily joining the front plate to an upper plate disposed on an upper portion of the front plate; and temporarily joining a rear plate disposed to be farther from the ball joint than the front plate.

In the temporarily joining of the front plate, a lateral plate disposed on a lateral surface of the front plate may also be temporarily joined.

The method may further include welding the temporarily joined inner diaphragm before the temporarily joining of the rear plate.

The method may further include welding the upper plate, the lower plate, the rear plate, and the lateral plate, which are temporarily joined, after the temporarily joining of the rear plate.

The temporarily joining or the welding of the rear plate may be performed between the rear plate and an outer peripheral surface of the upper plate and between the rear plate and an outer peripheral surface of the lower plate.

The inner diaphragm may include a plurality of diaphragm members disposed to be spaced apart from one another in a width of a welded portion between the ball joint and the front plate, and the plurality of diaphragm members may be welded between the upper plate and the lower plate.

According to the embodiments of the present disclosure, the blade support frame for a dozer and the method of manufacturing the same may effectively prevent deformation of and damage to the blade support frame for a dozer by effectively dispersing a load applied to the welded portion of the ball joint.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
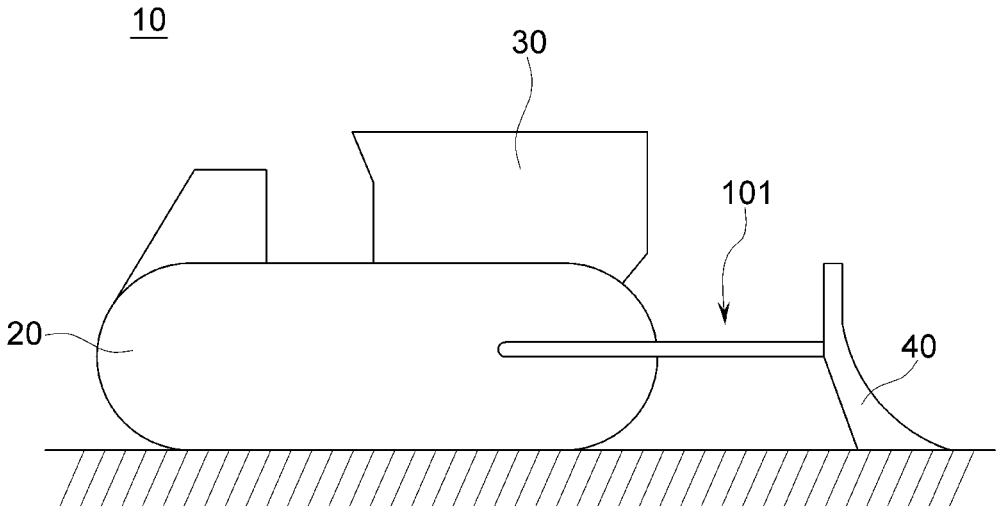
FIG. 1 is a view illustrating a dozer equipped with a blade support frame for a dozer according to an embodiment of the present disclosure.
Figure 2:
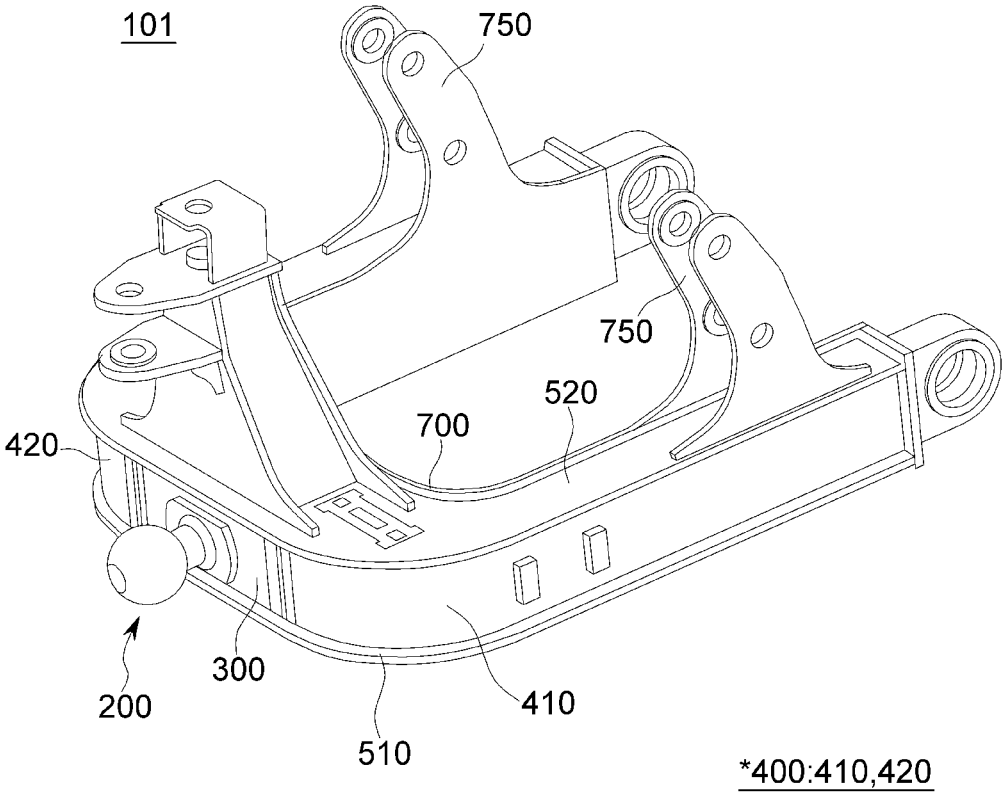
FIG. 2 is a view illustrating the blade support frame for a dozer according to the embodiment of the present disclosure.

In the following detailed description, reference is made to the accompanying drawing, which forms a part hereof. The illustrative embodiments described in the detailed description, drawing, and claims are not meant to be limiting. Other embodiments may be utilized, and other changes may be made, without departing from the spirit or scope of the subject matter presented here.

Hereinafter, embodiments of the present disclosure will be described in detail with reference to the accompanying drawings so that those with ordinary skill in the art to which the present disclosure pertains may easily carry out the embodiments. The present disclosure may be implemented in various different ways, and is not limited to the embodiments described herein.

It is noted that the drawings are schematic and are not illustrated based on actual scales. Relative dimensions and proportions of parts illustrated in the drawings are exaggerated or reduced in size for the purpose of clarity and convenience in the drawings, and any dimension is just illustrative but not restrictive. The same reference numerals designate the same structures, elements or components illustrated in two or more drawings in order to exhibit similar characteristics.

Embodiments of the present disclosure illustrate ideal embodiments of the present disclosure in detail. As a result, various modifications of the drawings are expected. Therefore, the embodiments are not limited to specific forms in regions illustrated in the drawings, and for example, include modifications of forms by the manufacture thereof.

Hereinafter, a blade support frame 101 for a dozer according to an embodiment of the present disclosure will be described with reference to FIGS. 1 to 5.

As illustrated in FIG. 1, a dozer 10 has the blade support frame 101 for a dozer installed on a main body 30 and adjusts a height and an angle of a blade 40. Specifically, rotation angles and positions of the blade 40 and the blade support frame 101 for a dozer may be adjusted with respect to the main body 30 by a non-illustrated drive unit.

The dozer 10 includes the main body 30, a traveling body 20 installed below the main body 30, the blade 40 configured to adjust the position and angle thereof, and the blade support frame 101 for a dozer configured to support the blade 40 so that the position and angle of the blade 40 are adjustable.

One side of the blade support frame 101 for a dozer is supported on the main body 30 or the traveling body 20, and the other side of the blade support frame 101 for a dozer supports the blade 40 so that the blade 40 is rotatable.

As illustrated in FIGS. 2 to 5, the blade support frame 101 for a dozer according to the embodiment of the present disclosure includes a ball joint 200, a front plate 300, an upper plate 520, a lower plate 510, and an inner diaphragm 600.

One side of the ball joint 200 is in contact with the blade 40 and supports the blade 40 so that the blade 40 is rotatable. Specifically, one side of the ball joint 200 has a spherical shape and is in contact with the blade 40. The ball joint 200 may support leftward and rightward tilting motions of the blade 40.

The front plate 300 is coupled to the ball joint 200. Specifically, the front plate 300 may be coupled to the other side of the ball joint 200 and support the ball joint 200. In addition, the front plate 300 is elongated in one direction. The other side of the ball joint 200 may be coupled to a front surface of the front plate 300 by welding.

The upper plate 520 is disposed on an upper portion of the front plate 300. In addition, the upper plate 520 may be coupled to the upper portion of the front plate 300. Specifically, the upper plate 520 has an approximately "U" shape. Two opposite sides of the upper plate 520 may be supported on the main body 30, and the front plate 300 may be disposed on a middle portion of the upper plate 520 by welding.

The lower plate 510 is disposed on a lower portion of the front plate 300. In addition, the lower plate 510 may be coupled to the lower portion of the front plate 300. Specifically, the lower plate 510 has an approximately "U" shape. The front plate 300 may be disposed on a middle portion of the lower plate 510 by welding. For example, the front plate 300 may be disposed in one region of each of the upper and lower plates 520 and 510 which is most distant from the main body 30 (the front plate 300 may be closer to an outer peripheral side of each of the upper and lower plates 520 and 510 each having an approximately "U" shape than an inner peripheral side of each of the upper and lower plates 520 and 510). Specifically, the upper and lower plates 520 and 510 may each be provided in the form of an approximately "C"-shaped frame member.

The inner diaphragm 600 is disposed between the upper plate 520 and the lower plate 510. In addition, the inner diaphragm 600 may support a portion between the upper plate 520 and the lower plate 510. Specifically, the inner diaphragm 600 may support a space defined by the upper and lower plates 520 and 510 spaced apart from each other in a height direction of the front plate 300.

Therefore, since the blade support frame 101 for a dozer according to the embodiment of the present disclosure includes the inner diaphragm 600, it is possible to effectively disperse a force, which is applied to the ball joint 200, to the blade support frame 101 for a dozer so as to prevent stress from being concentrated between the ball joint 200 and the front plate 300. In addition, the inner diaphragm 600 may effectively prevent torsion and deformation of the upper and lower plates 520 and 510. Further, the inner diaphragm 600 may effectively disperse a load, which is transmitted to the ball joint 200 by a weight and load of soil applied to the blade 40, to the upper and lower plates 520 and 510.

Figure 3:
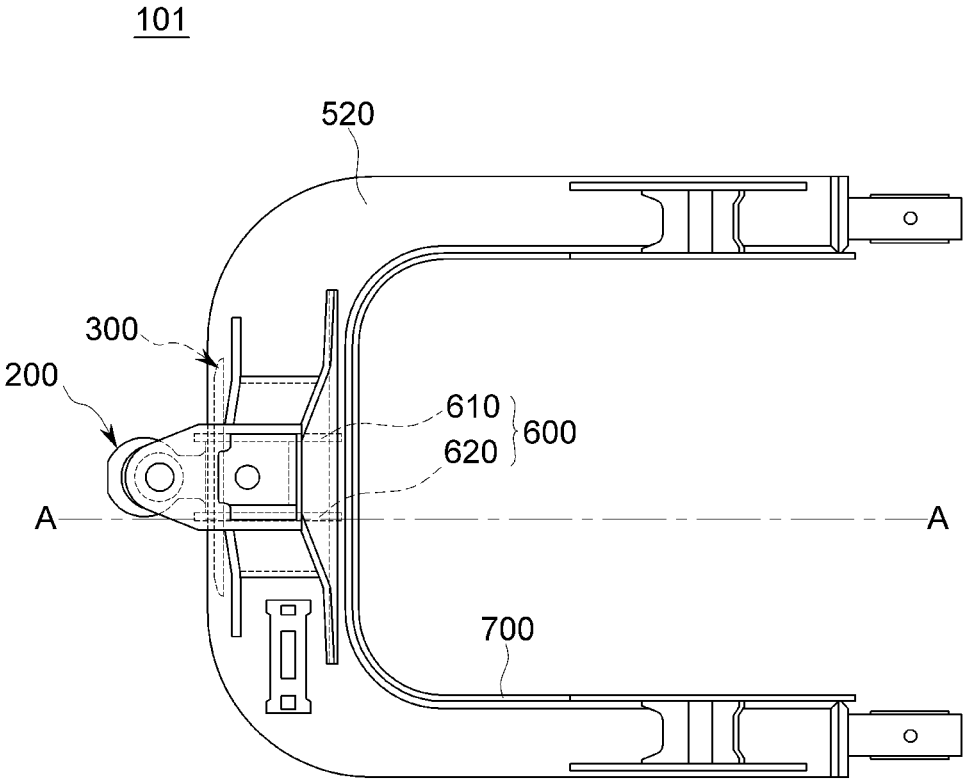
FIG. 3 is a top plan view of FIG. 2.
Figure 5:
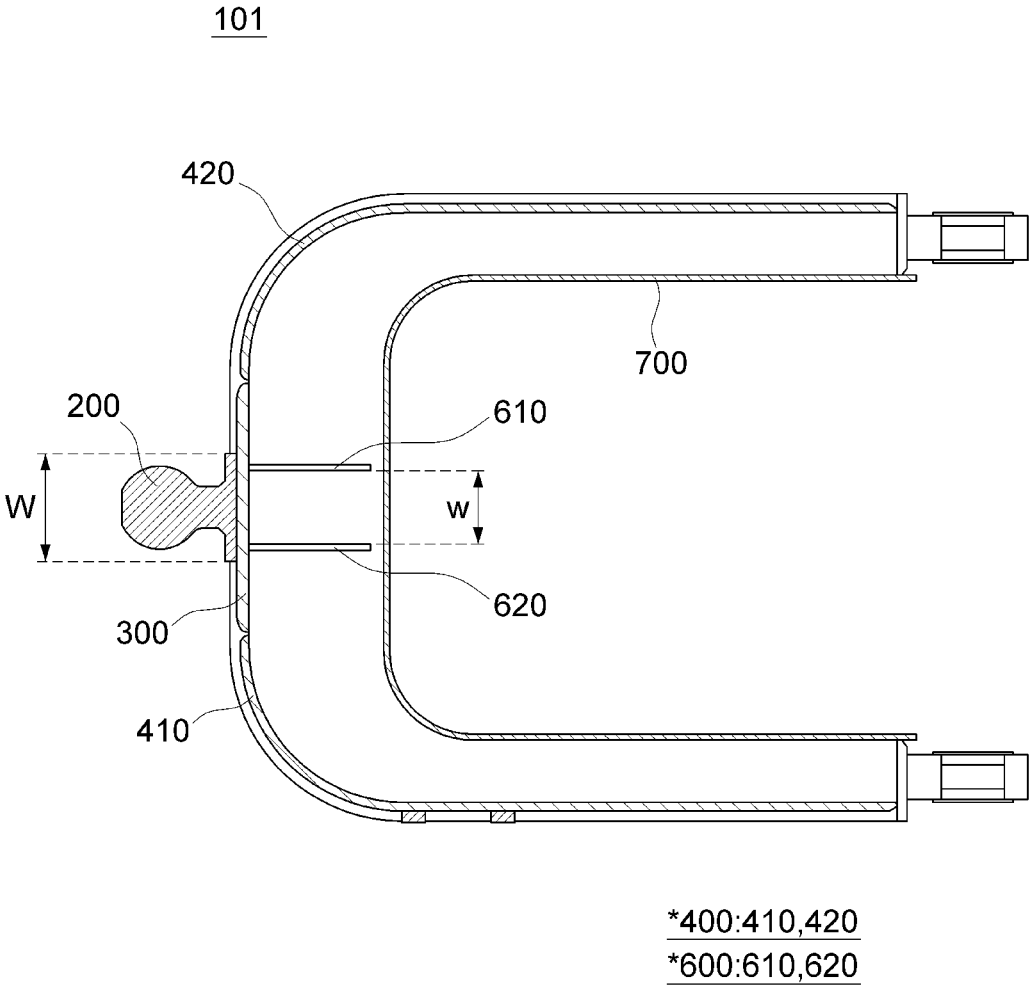
FIG. 5 is an interior cross-sectional view of FIG. 3.
Figure 6:
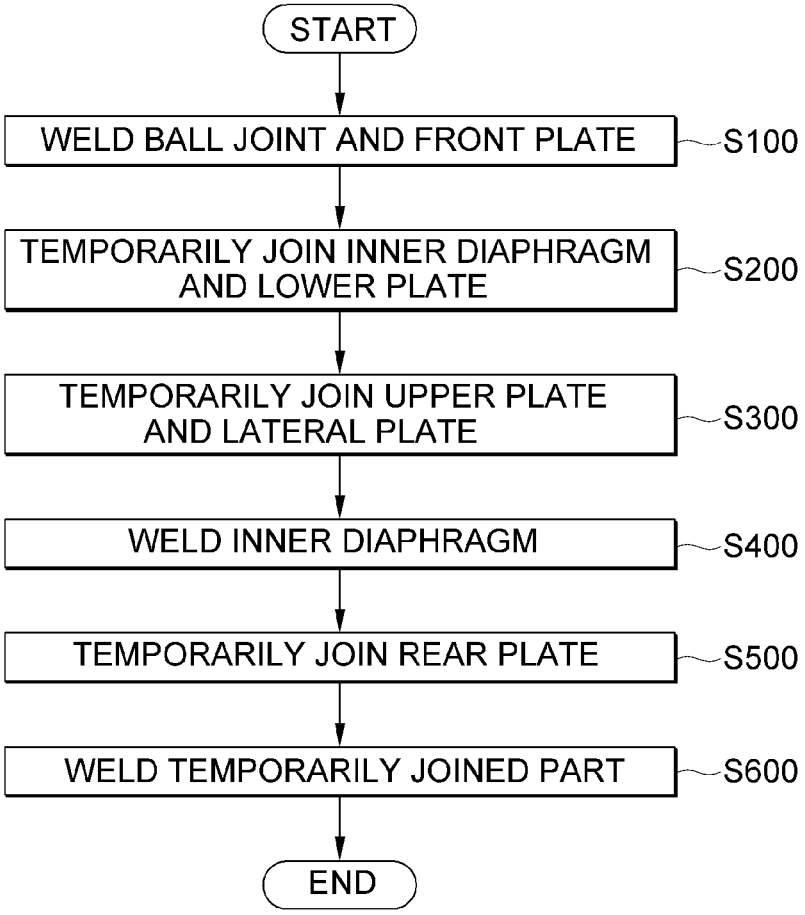
FIG. 6 is a flowchart illustrating a method of manufacturing a blade support frame for a dozer according to another embodiment of the present disclosure.

As illustrated in FIGS. 3 and 5, the inner diaphragm 600 of the blade support frame 101 for a dozer according to the embodiment of the present disclosure may include a plurality of diaphragm members 610 and 620. The plurality of diaphragm members 610 and 620 may be disposed to be spaced apart from one another in a width direction of each of the upper and lower plates 520 and 510.

For example, a pair of diaphragm members 610 and 620 may be provided and include a first diaphragm member 610 and a second diaphragm member 620.

The plurality of diaphragm members 610 and 620 may be disposed rearward from the front plate 300 having the front surface that supports the ball joint 200.

As illustrated in FIG. 5, a spacing width w between the plurality of diaphragm members 610 and 620 according to the embodiment of the present disclosure may be smaller than a width w of a coupling portion of the ball joint 200 coupled to the front plate 300. That is, the plurality of diaphragm members 610 and 620 may be spaced apart from one another and disposed rearward from the front plate 300 having the front surface welded to the ball joint 200. Specifically, a distance from an imaginary line running along a central portion of a plane of the ball joint 200 to an end of a coupling portion of the front plate 300 welded to the ball joint 200 may be longer than a distance from the imaginary line running along the central portion of the plane of the ball joint 200 to the first diaphragm member 610 or the second diaphragm member 620.

Therefore, since the spacing width w between the first and second diaphragm members 610 and 620 is smaller than the width w of the coupling portion of the front plate 300 coupled to the ball joint 200, the first and second diaphragm members 610 and 620 may effectively disperse the stress, which is concentrated on the welded portion between the other side of the ball joint 200 and the front side of the front plate 300, to the upper and lower plates 520 and 510.

That is, the plurality of diaphragm members 610 and 620 may effectively disperse the stress concentrated on the welded portion between the ball joint 200 and the front plate 300, thereby preventing damage to the blade support frame 101 for a dozer.

In addition, as illustrated in FIGS. 2 to 5, the blade support frame 101 for a dozer according to the embodiment of the present disclosure may further include a rear plate 700.

The rear plate 700 is disposed to be spaced apart from the front plate 300. The rear plate 700 may be disposed at inner peripheral sides of the upper and lower plates 520 and 510 each having an approximately "U" shape. In addition, a height of the rear plate 700 may be larger than of a height of the front plate 300. Further, one side in the height direction of the rear plate 700 may protrude in one direction upward from the upper plate 520, and the other side in the height direction of the rear plate 700 may protrude in the other direction downward from the lower plate 510.

Figure 4:
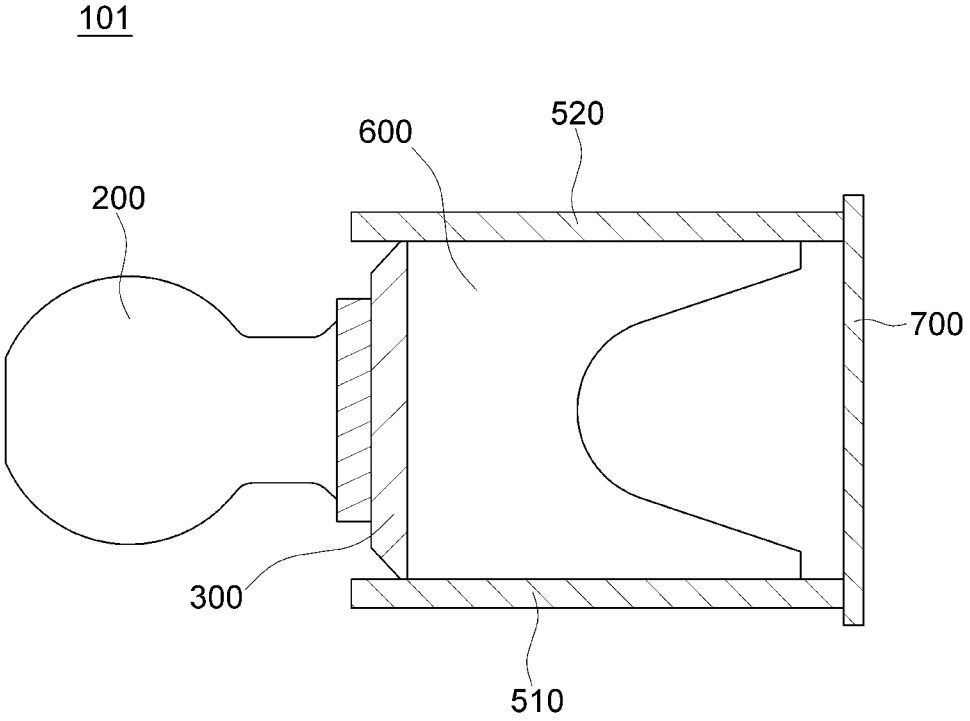
FIG. 4 is a cross-sectional view taken along line A-A in FIG. 3.

That is, as illustrated in FIG. 4, two opposite ends in the height direction of the rear plate 700 may further protrude from the upper and lower plates 520 and 510.

Therefore, the blade support frame 101 for a dozer according to the embodiment of the present disclosure makes it easy to perform the welding because the upper plate 520, the lower plate 510, and the rear plate 700 may be welded after a process of welding other plates. That is, the rear plate 700 may be easily welded lastly after the inner diaphragm 600 is stably welded.

Therefore, the welding process may be more smoothly performed in comparison with a case in which an edge of the rear plate 700 and an edge of the upper plate 520 are welded.

In addition, lugs 750 may extend from one side of an upper portion of the rear plate 700 and support a non-illustrated cylinder, which makes it possible to more effectively inhibit stress concentration due to welding in comparison with a case in which a lug, as a separate component, is welded to the upper plate or the rear plate.

That is, the blade support frame 101 for a dozer according to the embodiment of the present disclosure makes it possible to effectively weld the rear plate 700 even having the lugs 750 to the upper and lower plates 520 and 510.

The blade support frame 101 for a dozer according to the embodiment of the present disclosure may further include a lateral plate 400.

The lateral plate 400 may be disposed between the upper plate 520 and the lower plate 510. In addition, the lateral plate 400 may be disposed to be spaced apart from the rear plate 700. The lateral plate 400 may include a plurality of lateral plate members 410 and 420 spaced apart from one another with respect to the front plate 300, and the plurality of lateral plate members 410 and 420 may be respectively coupled to lateral surfaces of the front plate 300. That is, first and second lateral plate members 410 and 420 may be disposed in the longitudinal direction of the front plate 300 and spaced apart from each other between the upper plate 520 and the lower plate 510.

An upper portion of the lateral plate 400 may be coupled to the upper plate 520, a lower portion of the lateral plate 400 may be coupled to the lower plate 510, and one end of the lateral surface of the lateral plate 400, which is adjacent to the front plate 300, may be coupled to the lateral surface of the front plate 300.

One end of the outer peripheral side of each of the upper and lower plates 520 and 510 according to the embodiment of the present disclosure may further extend in an outer peripheral direction relative to the lateral plate 400 and the front plate 300.

The upper portion of the front plate 300 may face an inner side of the upper plate 520, and the lower portion of the front plate 300 may face an inner side of the lower plate 510. In addition, the upper portion of the lateral plate 400 may face an inner side of the upper plate 520, and the lower portion of the lateral plate 400 may face an inner side of the lower plate 510.

Therefore, the upper and the lower plates 520 and 510 may be stably welded and coupled to the front plate 300 and the lateral plate 400.

Therefore, the blade support frame 101 for a dozer according to the embodiment of the present disclosure includes the inner diaphragm 600 therein, which makes it possible to effectively disperse the stress, which is applied to the welded portion between the ball joint 200 and the front plate 300, to the upper and lower plates 520 and 510. In addition, since the upper and lower ends of the rear plate 700 may extend from the inner peripheral sides of the upper and lower plates 520 and 510, the rear plate 700, the upper plate 520, and the lower plate 510 may be effectively and easily welded after the inner diaphragm 600 is welded between the upper plate 520 and the lower plate 510.

Hereinafter, a method of manufacturing a blade support frame for a dozer according to another embodiment of the present disclosure will be described with reference to FIGS. 6 to 10.

The method of manufacturing the blade support frame for a dozer according to another embodiment of the present disclosure may be a method of manufacturing the above-mentioned blade support frame 101 for a dozer according to the embodiment of the present disclosure.

Figure 7:
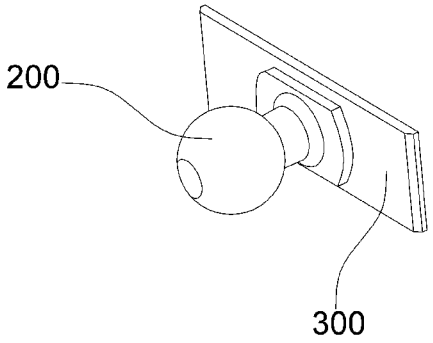
FIGS. 7 to 10 are views schematically illustrating a process of manufacturing the blade support frame for a dozer illustrated in FIG. 6.

As illustrated in FIG. 7, the front plate 300 is welded to the ball joint 200 configured to support the blade 40 so that the blade 40 is rotatable (S100). Specifically, one side of the ball joint 200 supports the blade 40 so that the blade 40 is tiltable, and the other side of the ball joint 200 is welded and coupled to the front portion of the front plate 300.

Figure 8:
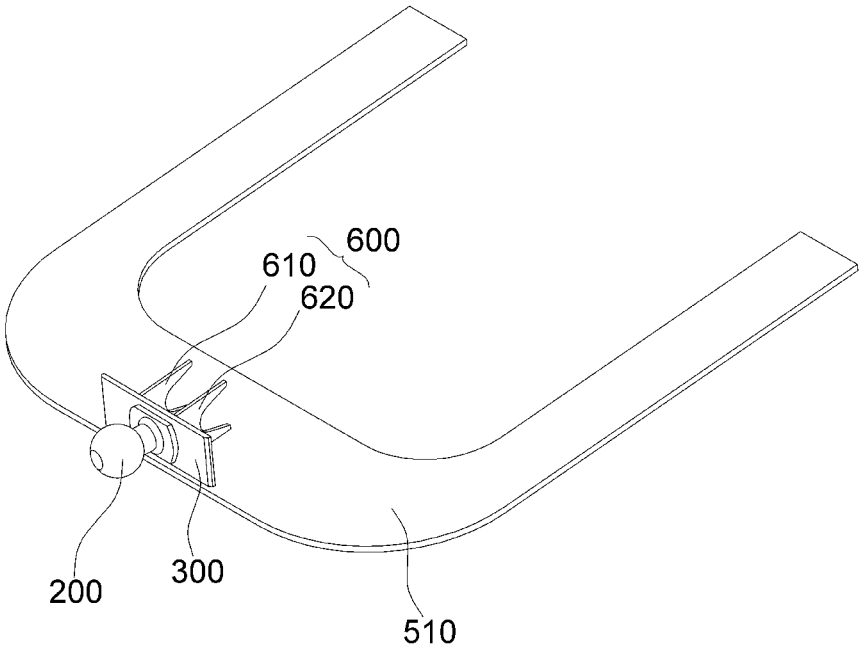

As illustrated in FIG. 8, the inner diaphragm 600 and the lower plate 510 are temporarily joined (S200). Specifically, the lower plate 510 is disposed on the lower portion of the front plate 300. Therefore, the lower portion of the inner diaphragm 600 and the lower plate 510 are temporarily joined (temporarily welded), such that an arrangement structure of the inner diaphragm 600 is set.

Since the inner diaphragm 600 includes the plurality of diaphragm members 610 and 620 spaced apart from one another, the plurality of diaphragm members 610 and 620 is temporarily joined to be disposed at the rear inner side of the front plate 300 welded to the other side of the ball joint 200, as illustrated in FIG. 8.

Figure 9:
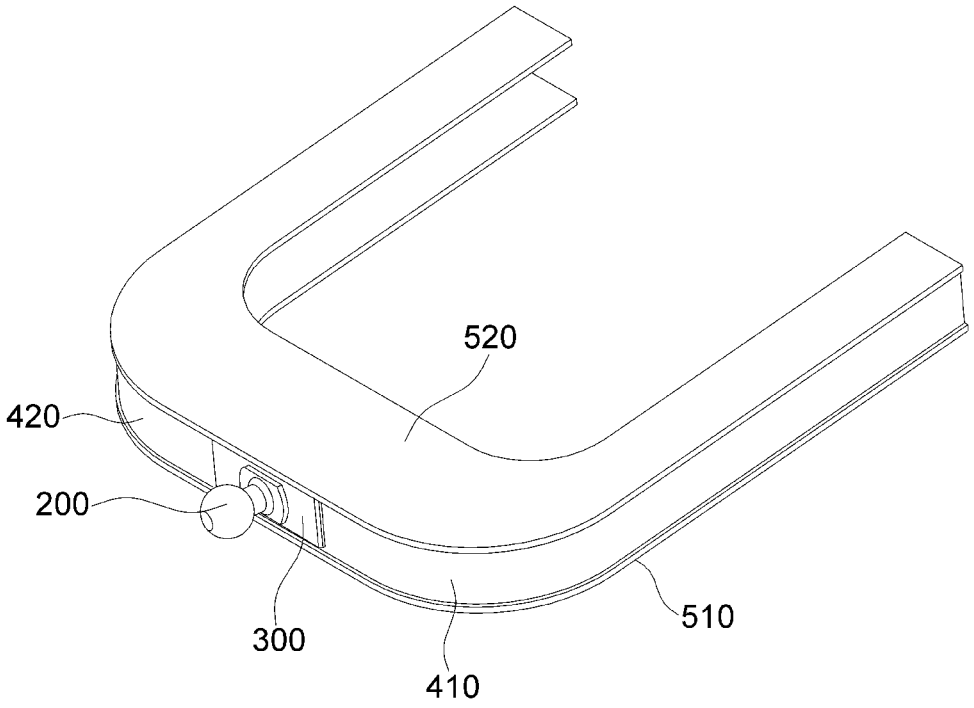

As illustrated in FIG. 9, the inner diaphragm 600, the upper plate 520, and the lateral plate 400 are temporarily joined (S300). Specifically, the inner diaphragm 600 is temporarily joined to the upper plate 520. In addition, the lateral plate 400 and the upper plate 520 are temporarily joined, and the lateral plate 400 and the lower plate 510 are temporarily joined.

The temporarily joined inner diaphragm 600 is welded to the upper and lower plates 520 and 510 (S400). That is, to fix the position of the temporarily joined inner diaphragm 600, the inner diaphragm 600 is fixedly welded between the upper plate 520 and the lower plate 510. In other words, the inner side of the upper plate 520, the inner side of the lower plate 510, and the two opposite ends in the height direction of the inner diaphragm 600 may be fixedly welded.

Figure 10:
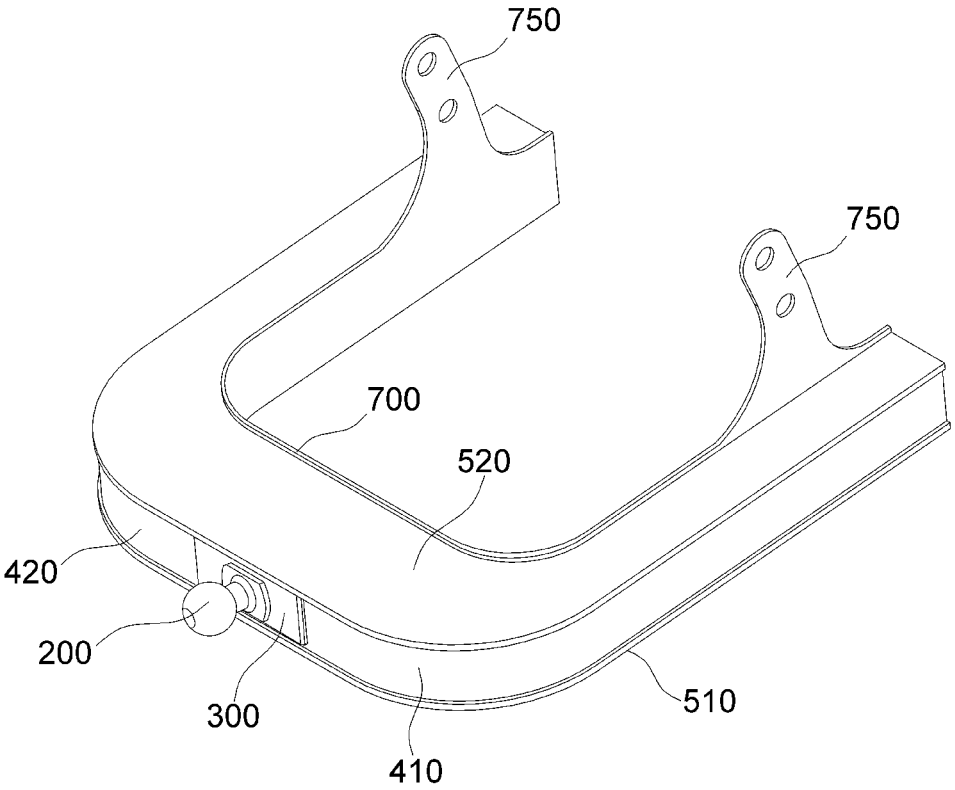

As illustrated in FIG. 10, the rear plate 700 is temporarily joined to the upper and the lower plates 520 and 510 (S500). The rear plate 700 is temporarily joined to the inner peripheral side of each of the upper and lower plates 520 and 510. Specifically, the two opposite ends in the height direction of the rear plate 700 in the direction parallel to the height direction of the front plate 300 extend and protrude toward the upper and lower plates 520 and 510. Therefore, the outer side of the upper plate 520, the outer peripheral side of the rear plate 700, the outer side of the lower plate 510, and the outer peripheral side of the rear plate 700 are temporarily joined to position the rear plate 700.

After the rear plate 700 is temporarily joined, the rear plate 700, the upper plate 520, the rear plate 700, and the lower plate 510, which are temporarily joined, are welded (S600). Specifically, the rear plate 700 further extends upward from the upper plate 520, and the rear plate 700 further extends downward from the lower plate 510, such that the rear plate 700 may be welded lastly. That is, the rear plate 700 may be easily welded to the upper and the lower plates 520 and 510 after the inner diaphragm 600 is welded between the upper and lower plates 520 and 510.

Therefore, the method of manufacturing the blade support frame for a dozer according to another embodiment of the present disclosure may easily fix the inner diaphragm 600 between the upper plate 520 and the lower plate 510. In addition, the inner diaphragm 600 may disperse the stress concentration, which is applied to the welded portion between the ball joint 200 and the front plate 300, to the upper and lower plates 520 and 510. Further, the method of manufacturing the blade support frame for a dozer may reduce the number of welding processes or easily perform the welding at the time of manufacturing the blade support frame 101 for a dozer.

While the embodiments of the present disclosure have been described with reference to the accompanying drawings, those skilled in the art will understand that the present disclosure may be carried out in any other specific form without changing the technical spirit or an essential feature thereof.

Accordingly, it should be understood that the aforementioned exemplary embodiments are described for illustration in all aspects and are not limited, and the scope of the present disclosure shall be represented by the claims to be described below, and it should be construed that all of the changes or modified forms induced from the meaning and the scope of the claims, and an equivalent concept thereto are included in the scope of the present disclosure.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A blade support frame for a dozer, which supports a blade, the blade support frame comprising:

a ball joint configured to support the blade so that the blade is rotatable;

a front plate coupled to the ball joint;

an upper plate disposed on an upper portion of the front plate and coupled to the front plate;

a lower plate disposed on a lower portion of the front plate and coupled to the front plate;

an inner diaphragm disposed between the upper plate and the lower plate and configured to support a portion between the upper plate and the lower plate;

a rear plate disposed to be spaced apart from the front plate and having one side further protruding from the upper plate in one direction and the other side further protruding from the lower plate in the other direction; and a lug disposed on the rear plate or the upper plate and protruding upward to support a cylinder.

2. The blade support frame of claim 1, wherein the inner diaphragm comprises a plurality of diaphragm members disposed to be spaced apart from one another, and a spacing width between the plurality of diaphragm members is smaller than a width of a coupling portion of the ball joint coupled to the front plate.

3. The blade support frame of claim 1, further comprising:

a lateral plate disposed between the upper plate and the lower plate, spaced apart from the rear plate, and coupled to a lateral surface of the front plate.

4. A blade support frame for a dozer, which supports a blade, the blade support frame comprising:

a ball joint configured to support the blade so that the blade is rotatable;

a front plate coupled to the ball joint;

an upper plate disposed on an upper portion of the front plate and coupled to the front plate;

a lower plate disposed on a lower portion of the front plate and coupled to the front plate;

an inner diaphragm disposed between the upper plate and the lower plate, configured to support a portion between the upper plate and the lower plate, and comprising a plurality of diaphragm members disposed such that a spacing width therebetween is smaller than a width of a coupling portion of the ball joint coupled to the front plate;

a rear plate disposed to be spaced apart from the front plate and having one side further protruding from the upper plate in one direction and the other side further protruding from the lower plate in the other direction; and a lateral plate entirely disposed between the upper plate and the lower plate, spaced apart from the rear plate, and coupled to a lateral surface of the front plate.

5. A method of manufacturing a blade support frame for a dozer that supports a blade, wherein the blade support frame comprises:

a ball joint configured to support the blade so that the blade is rotatable;

a front plate coupled to the ball joint;

an upper plate disposed on an upper portion of the front plate and coupled to the front plate;

a lower plate disposed on a lower portion of the front plate and coupled to the front plate;

an inner diaphragm disposed between the upper plate and the lower plate, configured to support a portion between the upper plate and the lower plate, and comprising a plurality of diaphragm members disposed such that a spacing width therebetween is smaller than a width of a coupling portion of the ball joint coupled to the front plate;

a rear plate disposed to be spaced apart from the front plate and having one side further protruding from the upper plate in one direction and the other side further protruding from the lower plate in the other direction; and a lateral plate entirely disposed between the upper plate and the lower plate, spaced apart from the rear plate, and coupled to a lateral surface of the front plate, the method comprising:

welding the front plate and the ball joint configured to support the blade so that the blade is rotatable;

temporarily joining an inner diaphragm to the lower plate disposed on the lower portion of the front plate;

temporarily joining the front plate to the upper plate disposed on the upper portion of the front plate; and temporarily joining the rear plate disposed to be farther from the ball joint than the front plate.

6. The method of claim 5, wherein in the temporarily joining of the front plate, the lateral plate disposed on the lateral surface of the front plate is also temporarily joined.

7. The method of claim 6, further comprising:

welding the upper plate, the lower plate, the rear plate, and the lateral plate, which are temporarily joined, after the temporarily joining of the rear plate.

8. The method of claim 7, wherein the temporarily joining or the welding of the rear plate is performed between the rear plate and an outer peripheral surface of the upper plate and between the rear plate and an outer peripheral surface of the lower plate.

9. The method of claim 7, wherein the inner diaphragm comprises a plurality of diaphragm members disposed to be spaced apart from one another in a width of a welded portion between the ball joint and the front plate, and the plurality of diaphragm members is welded between the upper plate and the lower plate.

10. The method of claim 5, further comprising:

welding the temporarily joined inner diaphragm before the temporarily joining of the rear plate.

* * * * *